US011292271B2

(12) United States Patent
Nakamura et al.

(10) Patent No.: US 11,292,271 B2
(45) Date of Patent: Apr. 5, 2022

(54) HEATING DEVICE, LIQUID DISCHARGE APPARATUS, AND PRINTER

(71) Applicants: Daisuke Nakamura, Kanagawa (JP); Masato Ogawa, Kanagawa (JP); Kenji Nozawa, Ibaraki (JP); Kohki Asada, Tokyo (JP); Hiroshi Sawase, Kanagawa (JP); Kazuaki Kamihara, Tokyo (JP); Yoshihiro Takahashi, Tokyo (JP); Ryusaku Hida, Kanagawa (JP)

(72) Inventors: Daisuke Nakamura, Kanagawa (JP); Masato Ogawa, Kanagawa (JP); Kenji Nozawa, Ibaraki (JP); Kohki Asada, Tokyo (JP); Hiroshi Sawase, Kanagawa (JP); Kazuaki Kamihara, Tokyo (JP); Yoshihiro Takahashi, Tokyo (JP); Ryusaku Hida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/120,288

(22) Filed: Dec. 14, 2020

(65) Prior Publication Data

US 2021/0221149 A1 Jul. 22, 2021

(30) Foreign Application Priority Data

Jan. 16, 2020 (JP) ..... JP2020-004908
Nov. 2, 2020 (JP) ..... JP2020-183495

(51) Int. Cl.
*B41J 11/00* (2006.01)

(52) U.S. Cl.
CPC .... *B41J 11/00212* (2021.01); *B41J 11/00214* (2021.01); *B41J 11/00216* (2021.01)

(58) Field of Classification Search
CPC ..... B41J 11/00212; B41J 11/00216; B41J 11/00214
See application file for complete search history.

(56) References Cited

U.S. PATENT DOCUMENTS

2007/0046720 A1* 3/2007 Konno ..... B41J 11/00214 347/21
2008/0291240 A1 11/2008 Ohsako et al.
2011/0141209 A1 6/2011 Tsukamura et al.
2011/0228016 A1 9/2011 Nakamura
2012/0013671 A1* 1/2012 Houjou ..... B41J 11/002 347/16
2012/0056953 A1 3/2012 Nakamura
2012/0140010 A1 6/2012 Ogawa et al.
2012/0140011 A1 6/2012 Yamada
2012/0210838 A1 8/2012 Maeyama et al.
2013/0155158 A1 6/2013 Tsukamura
(Continued)

FOREIGN PATENT DOCUMENTS

JP 2012-111123 6/2012

*Primary Examiner* — Bradley W Thies
(74) *Attorney, Agent, or Firm* — Xsensus LLP

(57) ABSTRACT

A heating device includes a heat irradiator configured to heat a sheet on which a liquid is applied and is conveyed in a conveyance direction, an ultraviolet irradiator on a downstream of the heat irradiator in the conveyance direction, the ultraviolet irradiator configured to heat a portion of the sheet, and a circuitry configured to control an output of the heat irradiator and an output of the ultraviolet irradiator based on a thickness of the sheet.

16 Claims, 14 Drawing Sheets

(56) References Cited

U.S. PATENT DOCUMENTS

| | | | | |
|---|---|---|---|---|
| 2013/0222457 | A1 | 8/2013 | Nakada et al. | |
| 2013/0286061 | A1 | 10/2013 | Nakamura | |
| 2014/0029996 | A1* | 1/2014 | Nozawa ..... | G03G 15/1695 399/388 |

* cited by examiner

| BASIS WEIGHT OF SHEET (THICKNESS) | INNER TEMPERATURE | IR HEATER | UV-LED IRRADIATOR |
|---|---|---|---|
| LESS THAN 128 gsm | 150 °C OR ABOVE | 0% | 100% |
| | BELOW 150 °C | 50% | 100% |
| 128 gsm OR GREATER | 150 °C OR ABOVE | 70% | 0% |
| | BELOW 150 °C | 100% | 0% |

| BASIS WEIGHT OF SHEET (THICKNESS) | SHEET DETECTION | IR HEATER | UV-LED IRRADIATOR |
|---|---|---|---|
| LESS THAN 128 gsm | DETECTED | 0% | 100% |
| | NOT DETECTED | 50% | 0% |
| 128 gsm OR GREATER | DETECTED | 100% | 100% |
| | NOT DETECTED | 70% | 0% |

FIG. 15A

| RIPPLES IN SHEET FROM R1: POOR TO R5: GOOD | | OUTPUT OF ULTRAVIOLET HEATER IN LOW-SPEED MODE | | | | | |
|---|---|---|---|---|---|---|---|
| | | 50% | 60% | 70% | 80% | 90% | 100% |
| OUTPUT OF INFRARED HEATER IN LOW-SPEED MODE | 0% | × | × | × | × | × | R5 |
| | 10% | × | × | × | × | × | R5 |
| | 20% | × | × | × | × | R5 | R5 |
| | 30% | × | × | × | R4 | R4 | R5 |
| | 40% | × | × | R4 | R4 | R4 | R4 |
| | 50% | × | R3 | R3 | R3 | R4 | R4 |
| | 60% | R2 | R3 | R3 | R3 | R3 | R4 |
| | 70% | R2 | R2 | R3 | R3 | R3 | R3 |
| | 80% | R2 | R2 | R2 | R2 | R2 | R2 |
| | 90% | R1 | R1 | R2 | R2 | R2 | R2 |
| | 100% | R1 | R1 | R1 | R1 | R1 | R1 |

FIG. 15B

| RATIO OF IR OUTPUT / UV OUTPUT | | OUTPUT OF ULTRAVIOLET HEATER IN LOW-SPEED MODE | | | | | |
|---|---|---|---|---|---|---|---|
| | | 50% | 60% | 70% | 80% | 90% | 100% |
| OUTPUT OF INFRARED HEATER IN LOW-SPEED MODE | 0% | | | | | | 0.00 |
| | 10% | | | | | | 0.10 |
| | 20% | | | | | 0.22 | 0.20 |
| | 30% | | | | 0.38 | 0.33 | 0.30 |
| | 40% | | | 0.57 | 0.50 | 0.44 | 0.40 |
| | 50% | | 0.83 | 0.71 | 0.63 | 0.56 | 0.50 |
| | 60% | 1.20 | 1.00 | 0.86 | 0.75 | 0.67 | 0.60 |
| | 70% | 1.40 | 1.17 | 1.00 | 0.88 | 0.78 | 0.70 |
| | 80% | 1.60 | 1.33 | 1.14 | 1.00 | 0.89 | 0.80 |
| | 90% | 1.80 | 1.50 | 1.29 | 1.13 | 1.00 | 0.90 |
| | 100% | 2.00 | 1.67 | 1.43 | 1.25 | 1.11 | 1.00 |

HEATING DEVICE, LIQUID DISCHARGE APPARATUS, AND PRINTER

CROSS-REFERENCE TO RELATED APPLICATIONS

This patent application is based on and claims priority pursuant to 35 U.S.C. § 119(a) to Japanese Patent Application No. 2020-004908, filed on Jan. 16, 2020, in the Japan Patent Office and Japanese Patent Application No. 2020-183495, filed on Nov. 2, 2020, in the Japan Patent Office, the entire disclosures of which are hereby incorporated by reference herein.

BACKGROUND

Technical Field

Aspects of the present disclosure relate to a heating device, a liquid discharge apparatus, and a printer.

Related Art

A printer applies a liquid onto a printing object such as a sheet to perform a printing operation. The printer includes a heater to heat the sheet onto which a liquid is applied to promote drying of the liquid applied onto the sheet.

The printer irradiates a water-based ink, which is applied from a head to a blanket body, with infrared rays by the first lamp. The first lamp heats and dries or heats and cures the ink on the blanket body with infrared rays. The printer transfers heated ink on the blanket body to a printing sheet. The printer further irradiates the ink on the printing sheet with ultraviolet rays by a second lamp to dry or cure the ink on the printing sheet with ultraviolet rays.

SUMMARY

In an aspect of this disclosure, a heating device includes a heat irradiator configured to heat a sheet on which a liquid is applied and is conveyed in a conveyance direction, an ultraviolet irradiator on a downstream of the heat irradiator in the conveyance direction, the ultraviolet irradiator configured to heat a portion of the sheet, and a circuitry configured to control an output of the heat irradiator and an output of the ultraviolet irradiator based on a thickness of the sheet.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein:

FIGS. 15A and 15B are tables to illustrate an operational effect of the dryer according to the second embodiment:

Figure 1:
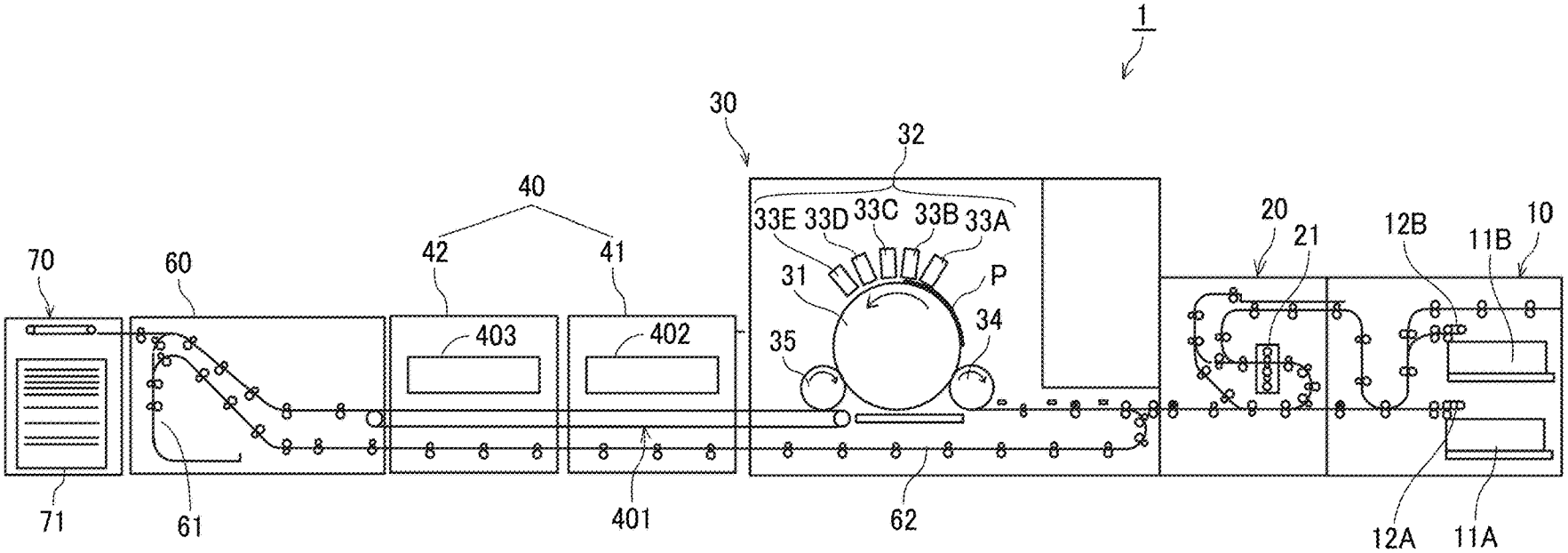
FIG. 1 is a schematic cross-sectional side view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. A printer 1 as a liquid discharge apparatus according to a first embodiment of the present disclosure is described with reference to FIGS. 1 and 3.

Figure 2:
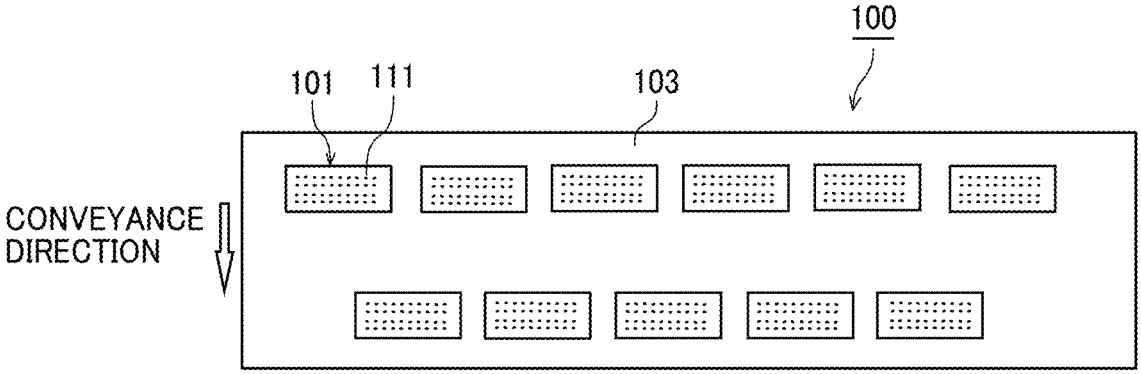
FIG. 2 is a plan view of a discharge unit of the printer.
Figure 3:
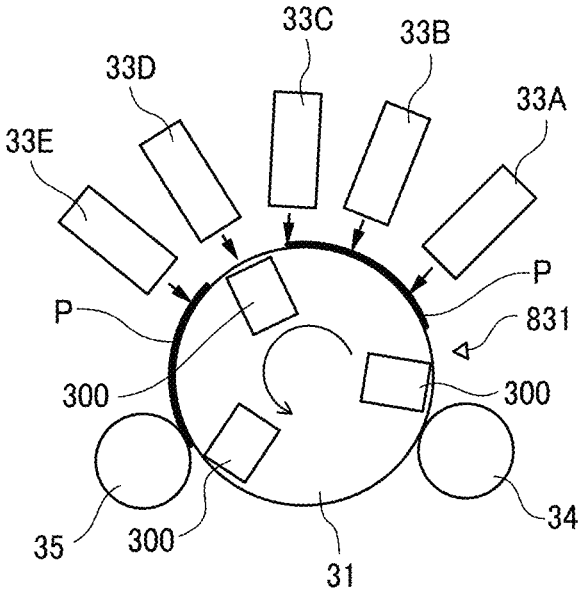
FIG. 3 is a printing unit of the printer around a drum of FIG. 1.

FIG. 1 is a schematic cross-sectional side view of the printer 1 according to the first embodiment of the present disclosure. FIG. 2 is a schematic plan view of a discharge unit of the printer 1. FIG. 3 is a printing unit of the printer around a drum of FIG. 1.

The printer 1 according to the first embodiment includes a loading unit 10 to load a sheet P into the printer 1, a pretreatment unit 20 as an applier, a printing unit 30, a dryer 40, a reverse mechanism 60, and an ejection unit 70.

In the printer 1, the pretreatment unit 20 applies, as required, a pretreatment liquid as an application liquid onto the sheet P fed (supplied) from the loading unit 10, the printing unit 30 applies a desired liquid onto the sheet P to perform required printing.

After the printer 1 dries the liquid adhering to the sheet P by the dryer 40, the printer 1 ejects the sheet P to the ejection unit 70 without printing on a back surface of the sheet P. The printer 1 may print on both sides of the sheet P via the reversing mechanism 60 after the printer 1 dries the liquid adhering to the sheet P by the dryer 40, and the printer 1 then ejects the sheet P to the ejection unit 70.

The loading unit 10 includes loading trays 11 (a lower loading tray 11A and an upper loading tray 11B) to accommodate a plurality of sheets P and feeding units 12 (a feeding unit 12A and a feeding unit 12B) to separate and feed the sheets P one by one from the loading trays 11 and supplies the sheets P to the pretreatment unit 20.

The pretreatment unit 20 includes, for example, a coater 21 as a treatment-liquid application unit that coats a printing surface of the sheet P with a treatment liquid having an effect of aggregation of ink particles to prevent bleed-through.

The printing unit 30 includes a drum 31 and a liquid discharge device 32. The drum 31 is a bearer (rotating member) that bears the sheet P on a circumferential surface of the drum 31 and rotates. The liquid discharge device 32 discharges liquid toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the first dryer 41.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31, and a suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction unit. As the drum 31 rotates, the sheet P is conveyed.

The liquid discharge device 32 includes discharge units 33 (discharge units 33A to 33E) to discharge liquids onto the sheet P as a liquid application unit. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K), respectively. Further, the discharge unit 33E discharges a special liquid, that is, a liquid of spot color such as white, gold, or silver.

As illustrated in FIG. 2, for example, each of the discharge unit 33 includes a head array 100 including a full line head and includes a plurality of liquid discharge heads 101 arranged in a staggered manner on a base 103. Each of the liquid discharge head 101 includes a plurality of nozzle rows, and a plurality of nozzles 111 is arranged in each of the nozzle rows. Hereinafter, the liquid discharge head 101 is simply referred to as the "head 101."

The discharge unit 33 includes a sub tank (liquid container) to store the liquid to be supplied to each head 101 of the head array 100.

The printing unit 30 controls a discharge operation of each discharge unit 33 of the liquid discharge device 32 by a drive signal corresponding to print data. When the sheet P borne on the drum 31 passes through a region facing the liquid discharge device 32, the liquids of respective colors are discharged from the discharge units 33 toward the sheet P, and an image corresponding to the print data is formed on the sheet P.

Further, as illustrated in FIG. 3, the drum 31 includes a plurality of (here, three) discharge receptacles 300 in the drum 31 arranged at substantially equal angles. The printing unit 30 performs a dummy discharge operation that controls the head 101 to discharge a liquid (dummy discharge liquid) not to be applied to the sheet P to the discharge receptacle 300 when the printing unit 30 maintains and recovers the head 101 of the discharge unit 33. The discharge receptacle 300 may receive the liquid overflown from the sheet P when the printer 1 performs a borderless printing.

The printing unit 30 includes a thickness detector 831 disposed upstream of the most upstream discharge unit 33A in a conveyance direction of the sheet P as indicated by arrow that rotates counterclockwise in the drum 31 in FIG. 3. The thickness detector 831 detects a thickness of the sheet P.

The dryer 40 includes a first dryer 41 and a second dryer 42.

The first dryer 41 includes a heat irradiation device 402 as a heater such as an infrared heater (IR heater). The first dryer 41 irradiates the sheet P, to which the liquid is applied, with infrared rays to heat and dry the sheet P conveyed by a conveyance mechanism 401.

The second dryer 42 includes an ultraviolet irradiation device 403 as a heater. The second dryer 42 irradiates the sheet P, to which the liquid is applied and is passed through the first dryer 41, with the ultraviolet rays to heat and dry the sheet P conveyed by a conveyance mechanism 401.

The reverse mechanism 60 includes a reverse part 61 and a duplex conveyor 62. The reverse mechanism 60 reverses the sheet P that has passed through the dryer to dry a first surface of the sheet P onto which the liquid is applied when the printer 1 performs a duplex printing. The duplex conveyor 62 feeds the reversed sheet P back to upstream of the transfer cylinder 34 of the printing unit 30. The reverse part 61 reverses the sheet P by switchback manner.

The ejection unit 70 includes an ejection tray 71 on which a plurality of sheets P is stacked. The plurality of sheets P conveyed from the reverse mechanism 60 is sequentially stacked and held on the ejection tray 71.

The printer 1 according to the first embodiment prints the sheet P that is a cut sheet as an example. However, the printer 1 according to the first embodiments of the present disclosure can also be applied to an apparatus using a continuous medium (web) such as continuous paper or roll paper, an apparatus using a sheet material such as wallpaper, and the like.

Figure 4:
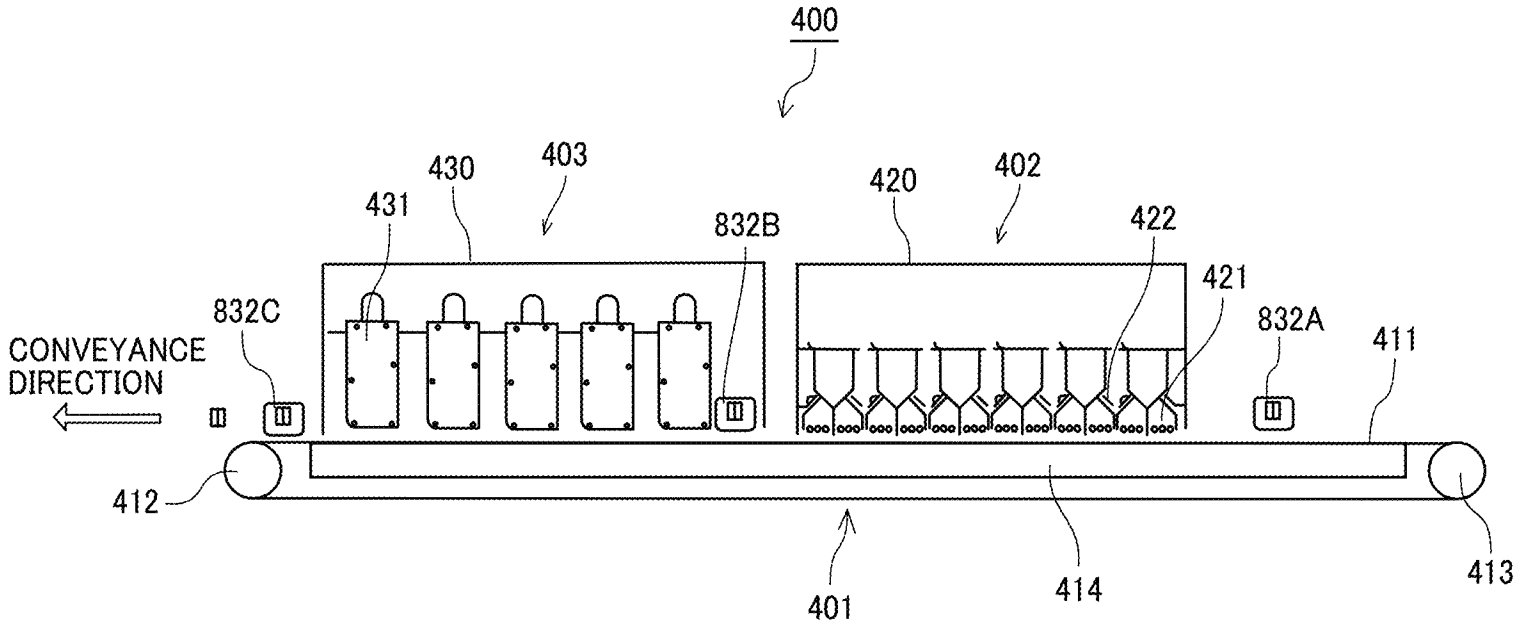
FIG. 4 is a schematic cross-sectional side view of a heating device according to the first embodiment of the present disclosure.

A heating device 400 according to a first embodiment of the present disclosure is described with reference to FIG. 4. FIG. 4 is a schematic cross-sectional side view of the heating device 400 according to the first embodiment of the present disclosure.

The heating device 400 includes a conveyance mechanism 401 as a conveyor, a heat irradiation device 402, and the ultraviolet irradiation device 403. The heating device 400 in FIG. 4 configures the dryer 40 illustrated in FIG. 1.

The conveyance mechanism 401 includes a conveyance belt 411 that bears and conveys the sheet P. The conveyance belt 411 is an endless belt stretched between a drive roller 412 and a driven roller 413. The conveyance belt 411 rotates to move the sheet P. The conveyance mechanism 401 according to the first embodiment includes a mechanism to convey the sheet P from the printing unit 30 to the reverse mechanism 60 as illustrated in FIG. 1.

The conveyance belt 411 is a belt that includes a plurality of openings from which an air is sucked by a suction chamber 414 arranged inside the conveyance belt 511. The conveyance belt 411 may be, for example, a mesh belt, a flat belt having a suction hole, or the like. The suction chamber 414 includes a suction blower, a fan, or the like to sucks the air through the plurality of openings in the conveyance belt 411 to attract the sheet P to the conveyance belt 411. The conveyor (conveyance mechanism 401) is not limited to the conveyor that uses suction method to attract the sheet P as described above. The conveyor may attract and convey the sheet P on the conveyance belt 511 by, for example, an electrostatic adsorption method or a gripping method using a gripper.

The heat irradiation device 402 includes a plurality of heat irradiators 421 arranged in a housing 420 along the conveyance direction of the sheet P. Each of the plurality of heat irradiators 421 includes an infrared heater (IR heater). The heat irradiator 421 irradiates and heats the sheet P conveyed by the conveyance mechanism 401 with infrared rays. The heat irradiation device 402 includes a temperature detector 422 to detect temperature of the heat irradiator 421.

The ultraviolet irradiation device 403 includes a plurality of ultraviolet irradiators 431 arranged in a housing 430 along the conveyance direction of the sheet P. The ultraviolet irradiators 431 irradiates the sheet P conveyed by the conveyance mechanism 401 with ultraviolet rays to heat the sheet P.

As described above, the heat irradiator 421 is arranged upstream of the ultraviolet irradiator 431 in the conveyance direction of the sheet P. That is, the ultraviolet irradiator 431 is arranged downstream of the heat irradiator 421 in the conveyance direction of the sheet P.

Further, heating device 400 includes sheet detectors 832 (832A to 832C) to detect presence or absence of the sheet P. The sheet detector 832A is disposed upstream of the heat irradiation device 402 (right end in FIG. 4). The sheet detector 832B is disposed between the heat irradiation device 402 and the ultraviolet irradiation device 403. The sheet detector 832C is disposed downstream of the ultraviolet irradiation device 403 (left end in FIG. 4).

Figure 5:
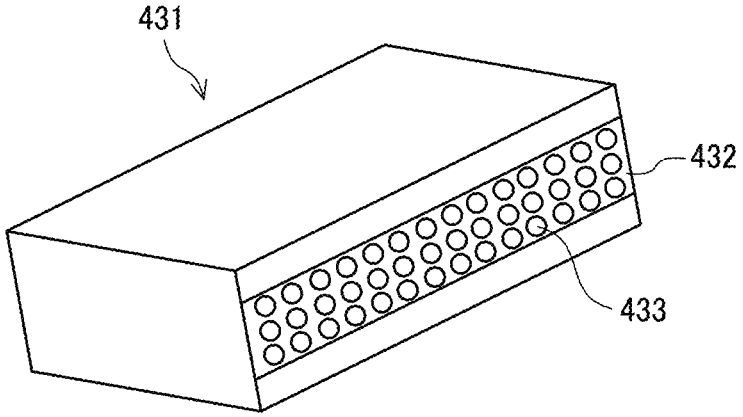
FIG. 5 is a schematic perspective view of an example of the ultraviolet irradiator.

Next, an example of the ultraviolet irradiator 431 is described with reference to FIG. 5. FIG. 5 is a schematic perspective view of an example of the ultraviolet irradiator 431.

The ultraviolet irradiator 431 includes granular ultraviolet light emitting diode elements 433 (UV-LED elements) arranged in a grid pattern on an irradiation surface 432. Since the UV-LED elements 433 emit light at the same illuminance, the ultraviolet irradiator 431 uniformly emits light along the irradiation surface 432 as a whole. As a wavelength of the ultraviolet light (UV light), a wavelength having a peak wavelength of 395 nm and a wavelength distribution having a full width at half maximum of about 15 nm is used.

The ultraviolet irradiator 431 can selectively heat the sheet P by irradiating the sheet P with ultraviolet rays. Thus, the ultraviolet irradiator 431 can obtain an effect of heating only an image part (a part to which the liquid is applied) and not excessively raising a temperature of a blank part (a part to which the liquid is not applied).

A result of comparison between the UV-LED elements 433 and the IR heater (IR lamp) is illustrated below.

A surface temperature of the sheet P after the sheet P has passed through the hating device 400 was measured while heating conditions (output settings of the IR lamp and the UV-LED elements 433) were varied to measure the temperatures of the image part and the blank part. The temperature of the image part and the temperature of the blank part of the sheet P were measured. When the temperature of the image part rose to around 90° C., moisture and solvent in a water-based ink evaporated and dried.

When the IR lamp heated the sheet P with a setting in which the temperature of the image part in the sheet P became 90° C., the temperature of the blank part in the sheet P became 105° C. at the same time of heating the image part.

Conversely, when the UV-LED elements 433 heated the sheet P with the setting in which the temperature of the image part became 90° C. as in a case of the IR lamp, the temperature of the blank part in the sheet P became 45° C. that was about 60° C. lower than the temperature of the blank part heated by the IR lamp.

Due to such a difference in the temperature of the blank part, moisture content of the blank part decreased from 6.1% to 1.4% by the heating of the IR lamp, whereas the moisture content of the blank part decreased only from 6.1% to 2.9% in the heating of the UV-LED elements 433.

That is, it was confirmed that the sheet P can retain more moisture in the blank part of the sheet P after the sheet P is heated (dried) by the ultraviolet ray emitted from the UV-LED elements 433.

Next, a different example of the thickness detector 831 to detect a thickness of the sheet P is described with reference to FIGS. 6 and 7.

Figure 6A:
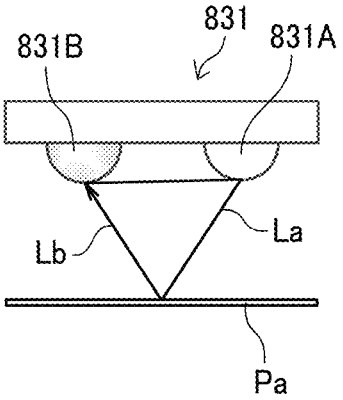
FIGS. 6A and 6B are schematic cross-sectional side view of an example of the thickness detector.
Figure 6B:
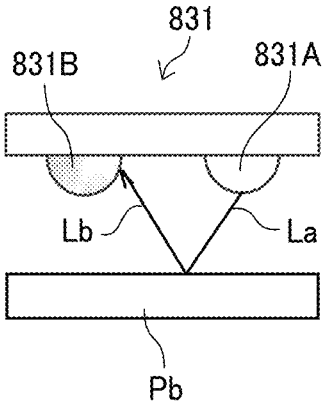
Figure 7A:
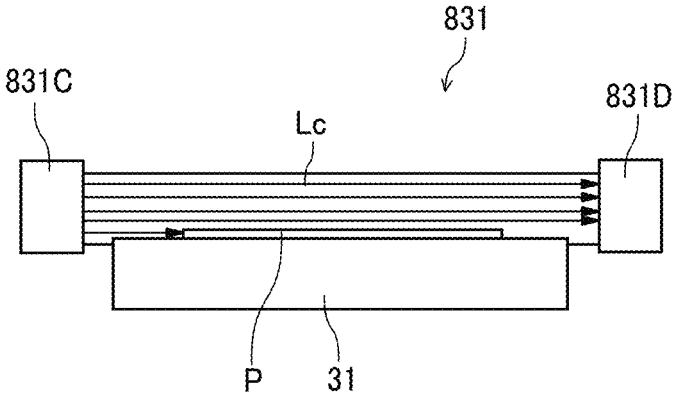
FIGS. 7A and 7B are schematic cross-sectional side view of another example of the thickness detector.
Figure 7B:
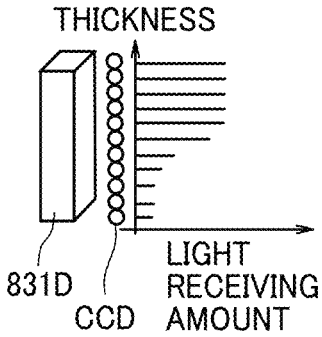

FIGS. 6A and 6B are schematic cross-sectional side view of an example of the thickness detector 831. FIGS. 7A and 7B are schematic cross-sectional side view of another example of the thickness detector 831.

The thickness detector 831 of a first example illustrated in FIG. 6 includes a light emitting element 831A that emits light La to the sheet P and a light receiving element 831B that receives reflected light Lb from the sheet P. An amount of light received by the light receiving element 831B changes between the sheet P that is a thin paper Pa as illustrated in FIG. 6A and the sheet P that is thick paper Pb as illustrated in FIG. 6B. Thus, the thickness detector 831 can detect the thickness of the sheet P.

The thickness detector 831 of a second example illustrated in FIG. 7 includes a projection device 831C and a charge-coupled device (CCD) light-receiving element 831D. The projection device 831C irradiates parallel light Lc in a direction parallel to an in-plane direction of the sheet P. The CCD light-receiving element 831D receives the parallel light Lc. As illustrated in FIG. 7A, a part of the parallel light Lc is blocked according to the thickness of the sheet P. As illustrated in FIG. 7B, an amount of light received by each charge-coupled device (CCD) that forms the CCD light-receiving element 831D changes. Thus, the thickness detector 831 can detect the thickness of the sheet P.

Figure 8:
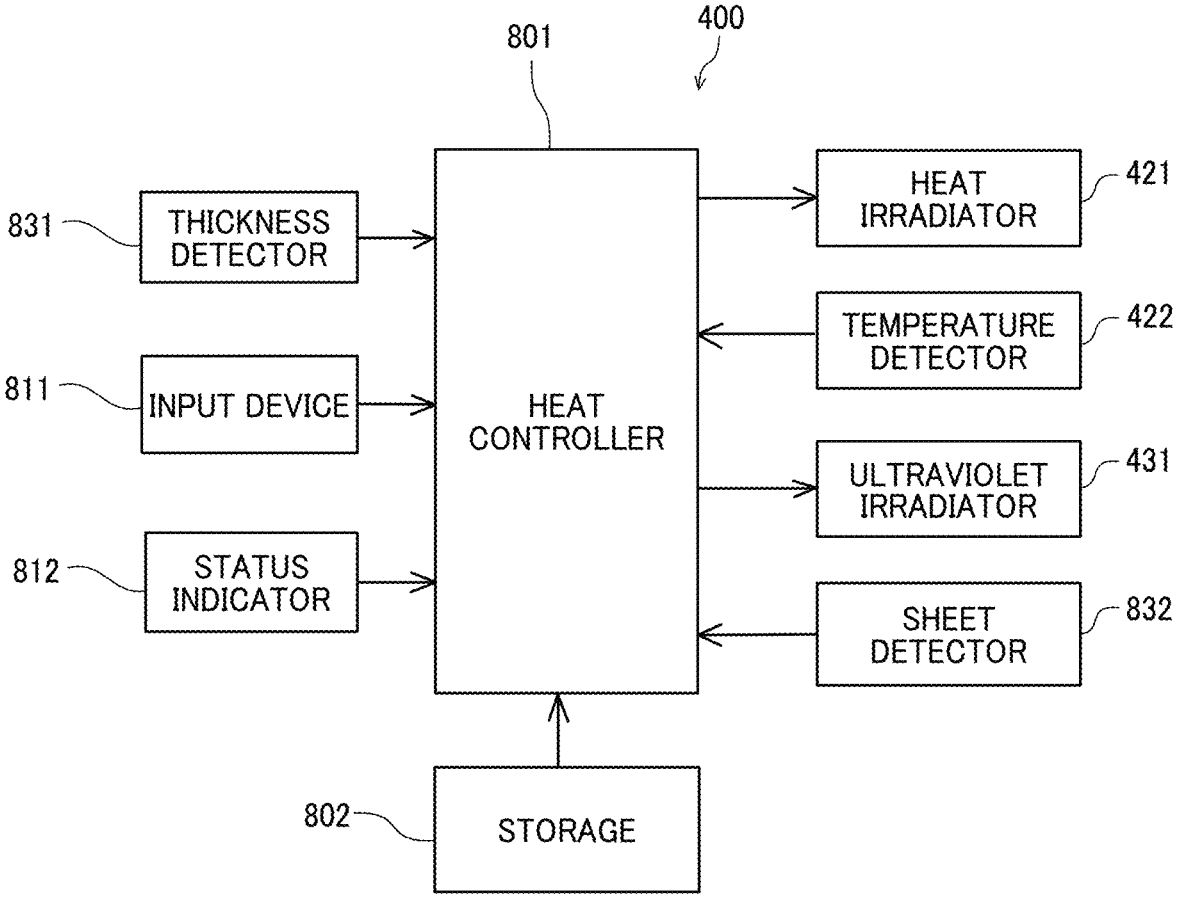
FIG. 8 is a block diagram of a portion related to the heat control of a dryer according to the first embodiment of the present disclosure.

Next, a portion related to a heat control of the dryer is described with reference to FIG. 8. FIG. 8 is a block diagram of a portion related to the heat control of the dryer according to the first embodiment of the present disclosure.

The hating device 400 includes a heat controller 801 that controls an output of each heat irradiators 421 of the heat irradiation device 402 and an output of each ultraviolet irradiators 431 of the ultraviolet irradiation device 403.

The hating device 400 includes a storage 802. The storage 802 stores relational information on a relation between the thickness of the sheet P and the output of the heat irradiator 421. The storage 802 also stores relational information on a relation between the thickness of the sheet P and the output of the ultraviolet irradiator 431. Further, the storage 802 stores relational information on a relation between a detection result of the sheet P and the output of the heat irradiator 421. The storage 802 also stores relational information on a relation between the detection result of the sheet P and the output of the ultraviolet irradiator 431.

The hating device 400 includes an input device 811 that is a user interface to input the thickness of the sheet P.

The d hating device 400 includes a status indicator 812 serves to display various status of devices in the hating device 400.

The hating device 400 includes a heat controller 801 that controls the heat irradiator 421 and the ultraviolet irradiator 431 to change the outputs of the heat irradiator 421 and the ultraviolet irradiator 431 according to the relational information stored in the storage 802 based on the detection result of the thickness of the sheet P by the thickness detector 831 and the thickness of the sheet P input by the input device 811.

The heat controller 801 controls the output of the heat irradiator 421 based on the detection result pf the temperature detector 422.

The heat controller 801 controls to change the outputs of the heat irradiator 421 and the ultraviolet irradiator 431 according to the relational information stored in the storage 802 based on the detection result of the sheet P detected by the sheet detector 832.

Next, an example of the relation between the thickness of the sheet P, the output of the heat irradiator 421, and the output of the ultraviolet irradiator 431 stored in the storage 802 is described with reference to a table of FIG. 9.

Figures 9, 10, 11:
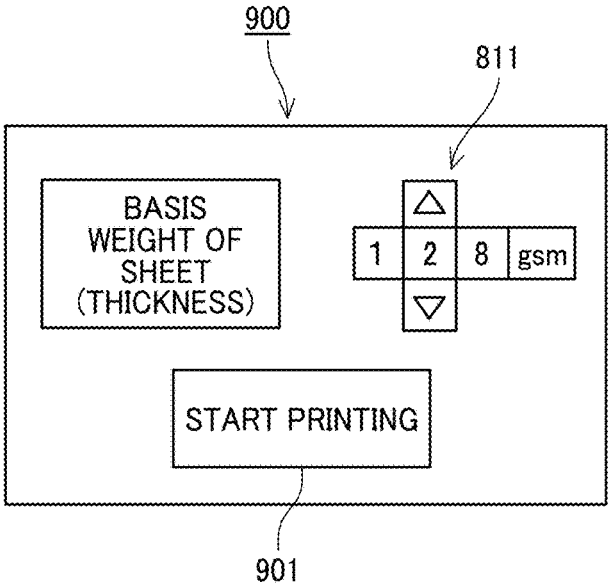
FIG. 9 is a table illustrating an example of a relation between a thickness of a sheet and an output of a heat irradiator and an output of an ultraviolet irradiator stored in a storage.
FIG. 10 is a table illustrating an example of a relation between the thickness of the sheet, a sheet detection by the sheet detector, and the outputs of the heat irradiator and the ultraviolet irradiator stored in the storage.
FIG. 11 is a schematic plan view of an operation panel including an input device according to the first embodiment of the present disclosure.

In FIG. 9, "an inner temperature" represents a temperature inside the heat irradiation device 402 of the first dryer 41 and a temperature inside the ultraviolet irradiation device 403 of the second dryer 42. The "IR heater (infrared heater)" represents the heat irradiator 421, and the ultraviolet light emitting diode irradiator (UV-LED irradiator) represents the ultraviolet irradiator 431 in FIG. 9.

In an example illustrated in FIG. 9, a predetermined value of a basis weight (thickness) of the sheet P is set to 128 grams per square meter (gsm). The sheet P is classified into the sheet P having the basis weight less than the predetermined value (128 gsm) and the sheet P having the bases weight equal to or larger than the predetermined value (128 gsm). The sheet P is further classified into the sheet P heated by the inner temperature equal to or larger than 150° C. the sheet P heated by the inner temperature below 150° C. for each of the thickness (basis weight) of the sheet P.

The inner temperature of 150° C. is set as a predetermined value (predetermined temperature) in FIG. 9. Then, the heat controller 801 determines the outputs of the heat irradiator 421 and the ultraviolet irradiator 431 for each classification of the thickness of the sheet P and the inner temperature.

The heat controller 801 thus changes each output of the heat irradiator 421 and the ultraviolet irradiator 431 based on the thickness of the sheet P. The heat controller 801 may change (adjust) the outputs of the heat irradiator 421 and the ultraviolet irradiator 431 to OFF (0% in FIG. 9).

Thus, the hating device 400 can apply sufficient heat energy to the sheet P to dry the sheet P by the heat irradiator 421 (IR heater) for a thick sheet P (thick paper) having the bases weight 128 gsm or larger that does not generate wrinkles due to moisture absorption.

Conversely, the hating device 400 dry only a portion of the sheet P to which the liquid is applied by the ultraviolet irradiator 431 for a thin sheet P (thin paper) having the bases weight less than 128 gsm in which wrinkles are likely to occur. Thus, the hating device 400 can dry the thin sheet P while reducing occurrence of wrinkles on the sheet P.

In an example illustrated in FIG. 9, the heat controller 801 sets the output of the heat irradiator 421 to 50% when the sheet P is the thin paper (basis weight less than 128 gsm) and the inner temperature is below 150° C.

Thus, the hating device 400 can prevent evaporation of moisture in the sheet P to reduce occurrence of wrinkles on the sheet P.

Next, an example of a relation between the thickness of the sheet P, a sheet detection by the sheet detector 832, and the outputs of the heat irradiator 421 and the ultraviolet irradiator 431 stored in the storage 802 is described with reference to a table of FIG. 10.

In FIG. 10, "sheet detection" represents the detection result of the sheet P by the sheet detector 832. The "IR heater (infrared heater)" represents the heat irradiator 421, and the ultraviolet light emitting diode irradiator (UV-LED irradiator) represents the ultraviolet irradiator 431 in FIG. 9.

In an example illustrated in FIG. 10, a predetermined value of a basis weight (thickness) of the sheet P is set to 128 grams per square meter (gsm). The sheet P is classified into the sheet P having the basis weight less than the predetermined value (128 gsm) and the sheet P having the bases weight equal to or larger than the predetermined value (128 gsm). The sheet P is further classified into the sheet P detected by the sheet detector 832 and the sheet P not detected by the sheet detector 832. Then, the heat controller 801 determines the outputs of the heat irradiator 421 and the ultraviolet irradiator 431 for each classification of the thickness of the sheet P and the sheet detection.

Then, the heat controller 801 controls the heat irradiator 421 not to irradiate the sheet P with heat (sets the output to 0%) when the thickness of the sheet P is less than the predetermined value (less than 128 gsm) and the sheet detector 832 detects the sheet P. Conversely, the heat controller 801 controls the heat irradiator 421 to irradiate the sheet P with heat (sets the output to 50%) when the thickness of the sheet P is less than the predetermined thickness (128 gsm or larger) and the sheet detector 832 does not detect the sheet P. Further, the heat controller 801 controls the heat irradiator 421 to irradiate the sheet P with heat (sets the output to 100% or 70%) when the thickness (bases weight) of the sheet P is equal to or larger than the predetermined thickness (128 gsm or larger) in both cases of the sheet detector 832 detecting the sheet P and not detecting the sheet P.

The heat controller 801 controls the heat irradiator 421 to emit heat when the sheet detector 832 does not detect the sheet P so that the heat controller 801 uses the heat irradiator 421 as an auxiliary heater (pre-heater). In the above case, the heat controller 801 keeps the inner temperature at a temperature at which the moisture of the sheet P does not evaporate so that idling time does not occur. Thus, the printer 1 can prevent a decrease in print speed. Further, the heat controller 801 changes the output of the heat irradiator 421 between the thickness of the sheet P less than the predetermined thickness (128 gsm) and the thickness of the sheet P equal to or larger than the predetermined thickness (128 gsm).

In an example illustrated in FIG. 10, the heat controller 801 sets the outputs of the heat irradiator 421 and the ultraviolet irradiator 431 to 100% when the sheet P is the thick paper (basis weight equal to or larger than 128 gsm) and the sheet detector 832 detects the sheet P.

The heat controller 801 sets the outputs of the heat irradiator 421 and the ultraviolet irradiator 431 to 100% because wrinkles do not occur even if the sheet P is strongly dried when the sheet P is a thick paper.

Next, an example of the input device 811 is described with reference to FIG. 11. FIG. 11 is a schematic plan view of an operation panel 900 including the input device 811 according to the first embodiment of the present disclosure.

The operation panel 900 includes the input device 811 to input the thickness (basis weight) of the sheet P and a print start key 901 by which the user instructs the printer 1 to start printing, for example.

Next, an example of heat control according to the first embodiment of the present disclosure is described with reference to a flowchart of FIG. 12.

First, the user sets the input thickness t0 of the sheet P by the input device 811 so that the input thickness t0 of the sheet P set in the heat controller 801 is input (step S1) to the heat controller 801. Hereinafter, "step S1" is simply referred to as "S1". Then, the user uses the print start key 901 to instruct the printer 1 to start printing (S2).

Here, the heat controller 801 adjusts the outputs of the heat irradiator 421 and the ultraviolet irradiator 431 according to the input thickness to of the sheet P input by the input device 811 (S3).

Then, the printer 1 starts printing (S4). The thickness detector 831 (sensor) detects the detected thickness t of the sheet P and input to the heat controller 801 (S5).

The heat controller 801 determines whether a difference between the input thickness t0 of the sheet P and the detected thickness (t1) of the sheet P is less than a predetermined value x, that is, $t1-t0<x$ (S6). The predetermined value x is set to, for example, 0.85 mm.

Figure 12:
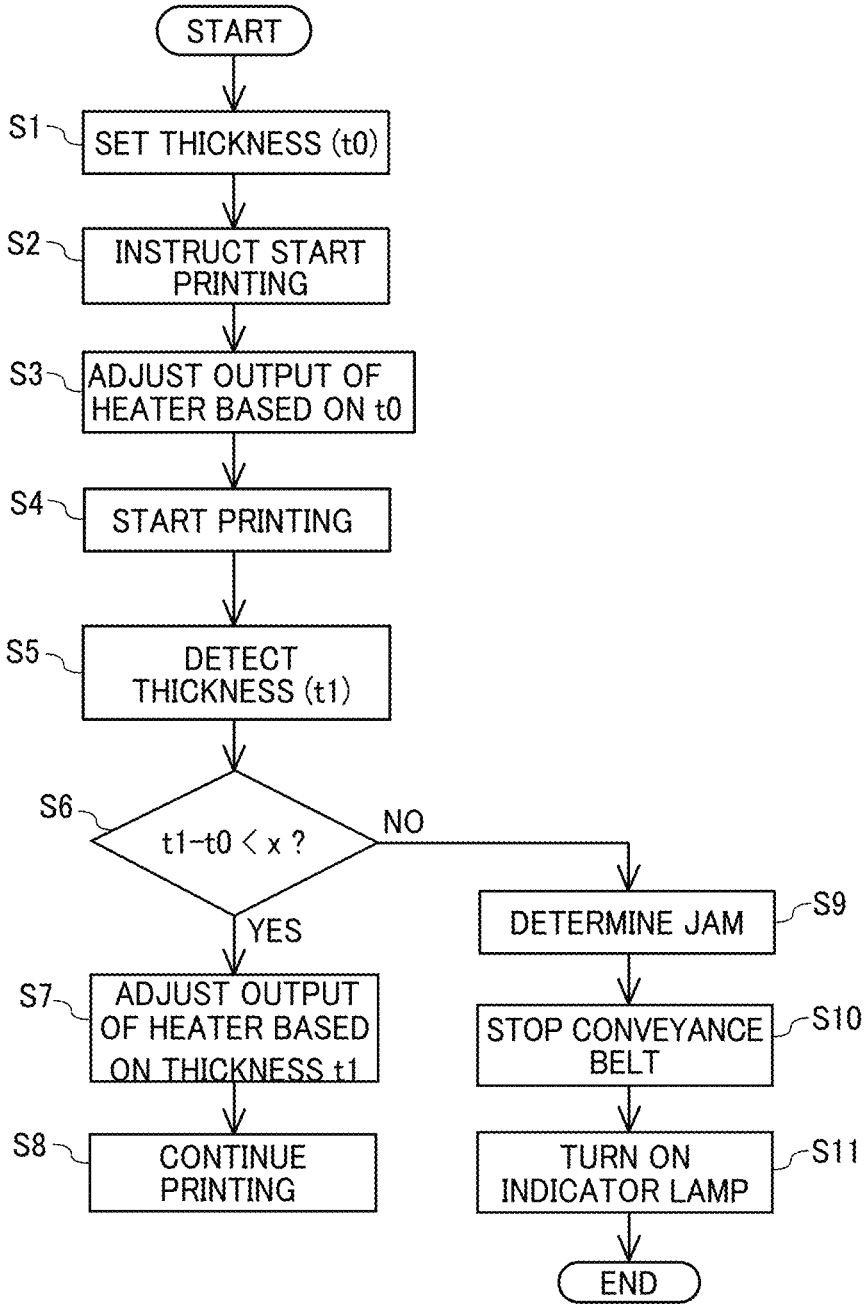
FIG. 12 is a flowchart illustrating an example of a heat control according to a first embodiment of the present disclosure.

If the heat controller 801 determines that the difference ($t1-t0$) is less that the predetermined value X ($t1-t0<x$), that is YES in S6 in FIG. 12, the heat controller 801 gives priority to the detected thickness t1 of the sheet over the input thickness (t) of the sheet P.

That is, the heat controller 801 adjusts each output of the heat irradiator 421 and the ultraviolet irradiator 431 (heaters) based on the relational information stored in the storage 802 corresponding to the detected thickness t1 of the sheet P (S7). Then, the heat controller continues a printing process (S8).

Thus, the hating device 400 can apply sufficient heat energy to the sheet P to dry the sheet P by the heat irradiator 421 (IR heater) for a thick sheet P (thick paper). Conversely, the hating device 400 dry only a portion of the sheet P to which the liquid is applied by the ultraviolet irradiator 431 for a thin sheet P (thin paper) to dry the thin sheet P while reducing occurrence of wrinkles on the sheet P. Thus, the hating device 400 can reduce an occurrence of wrinkles in the sheet P and efficiently dry the sheet P.

Conversely, if the heat controller 801 determines that the difference ($t1-t0$) is not less than the predetermined value X (S6, NO), that is, if the detected thickness t1 of the sheet P is equal to or larger than the input thickness t0 of the sheet P by the predetermined value x ($t1-t0\geq x$), the heat controller 801 determines that jam (JAM) is occurred (S9).

Then, the heat controller 801 stops a conveyance operation of the conveyance belt 411 (S10) and turns on an indicator lamp of the status indicator 812 (S12).

If a set value of the thickness of the sheet P (input thickness to) is larger than a measured value of the thickness of the sheet P (detected thickness t1 by the thickness detector 831), the heat controller 801 increases the output of the hating device 400. Thus, only wrinkles are occurred on the sheet P, and there is no damage to the printer 1.

Conversely, if the set value of the thickness of the sheet P (input thickness t0) is smaller than the measured value of the thickness of the sheet P (detected thickness t1 by the thickness detector 831), the heat controller 801 stops conveyance of the sheet P and stops the printing operation (liquid application operation) since the output of the hating device 400 is weak, the liquid on the sheet P does not dried that may damage the printer 1.

Figure 13:
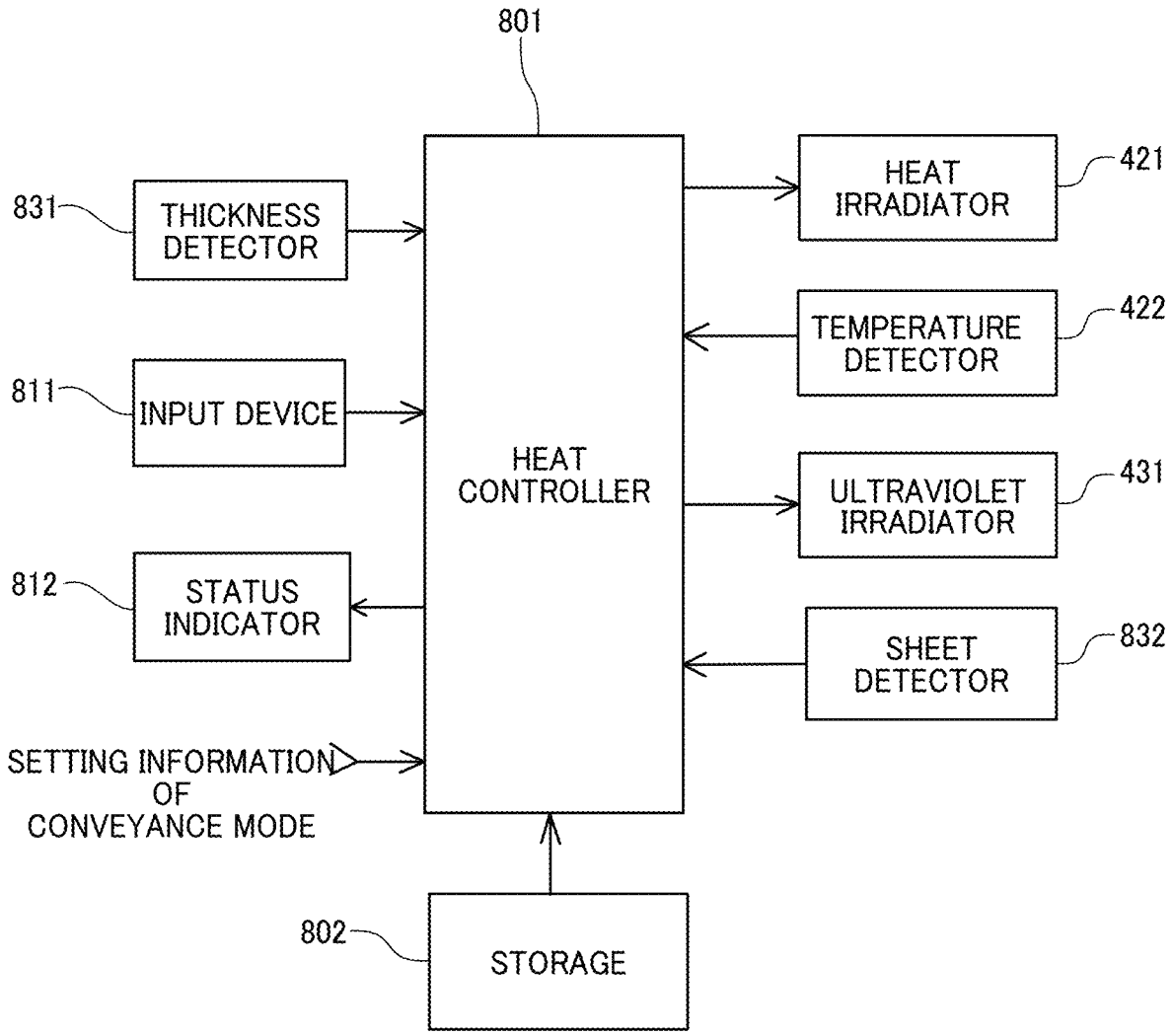
FIG. 13 is a block diagram of a portion related to a heat control according to a second embodiment of the present disclosure.

Next, a second embodiment of the present disclosure is described with reference to FIG. 13. FIG. 13 is a block diagram of a portion related to a heat control according to the second embodiment of the present disclosure.

The hating device 400 may not prevent ripples generated on a surface of the sheet P when the heat irradiator 421 and the ultraviolet irradiator 431 are used in combination to dry the sheet P as in the first embodiment and when the printer 1 prints an image pattern that likely generates ripples in the sheet P having the predetermined thickness (for example, a thickness of about 128 gsm).

On the other hand, if the hating device 400 does not use the heat irradiator 421 to dry the sheet P, the drying energy is insufficient to dry the sheet P and productivity is lowered. The image pattern that likely generates ripples on the sheet P is a pattern in which a plurality of pages of document is imposed. The document includes mixture of images and characters such as a magazine.

Therefore, the heat controller 801 controls (switches) at least the output of the heat irradiator 421 based on the conveyance speed obtained from setting information of a conveyance mode when the thickness of the sheet P is the predetermined thickness such as about 128 gsm.

The hating device 400 according to the second embodiment includes a conveyance mode that include a low-speed mode and a high-speed mode. The hating device 400 conveys the sheet P at a first speed (first conveyance speed) in the low-speed mode. The hating device 400 conveys the sheet P at a second speed (second conveyance speed) that is faster than the first speed. In the printer 1 according to the second embodiment, the user can manually input the setting information of the conveyance mode by the operation panel 90 of the printer 1 to designate the conveyance mode (conveyance speed).

The user may input the setting information of the conveyance mode to the heat controller 801 by the input device 811. The setting information of the conveyance mode is not limited to the information to set the conveyance mode itself but includes information that correlates with the conveyance mode (conveyance speed). Further, the "conveyance speed" means a linear conveyance velocity (process linear velocity) of the sheet P of an entire printer 1 that includes not only a linear velocity of the drying operation but also a linear velocity of the printing operation and the like.

The heat controller 801 according to the second embodiment controls the output of the heat irradiator 421 to a first output when the conveyance speed of the sheet P is at the first speed. The heat controller 801 controls the output of the heat irradiator 421 to a second output when the conveyance speed of the sheet P is at the second speed. The second speed is faster (larger) than the first speed as described above. Further, the first output is smaller (lower) than the second output.

Thus, the first output of the heat irradiator 421 when the conveyance speed of the sheet P is at the first speed is smaller than the second output of the heat irradiator 421 when the conveyance speed of the sheet P is at the second speed faster than the first speed.

Figure 14:
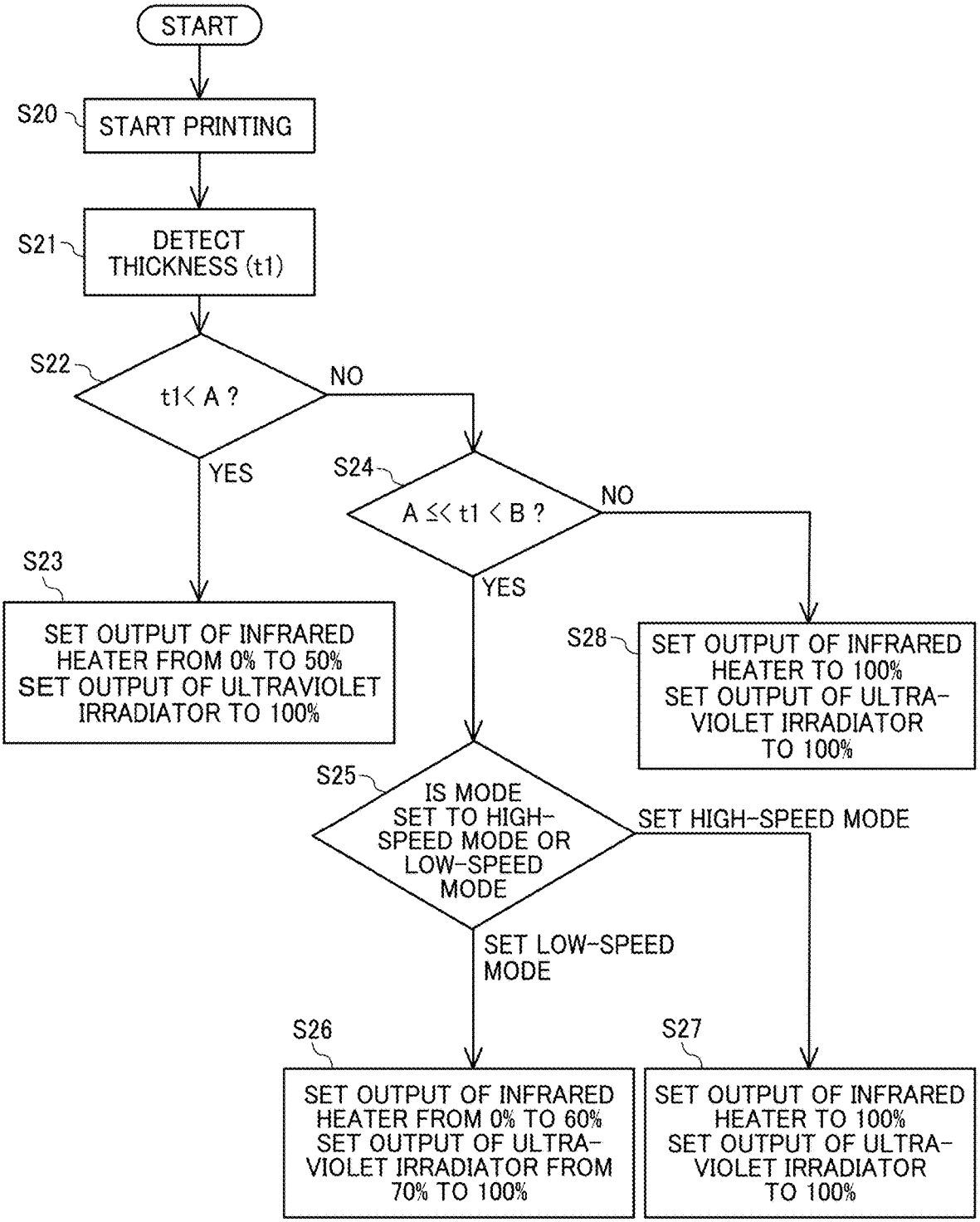
FIG. 14 is a flowchart illustrating an example of a heat control according to the second embodiment of the present disclosure.

Next, an example of heat control according to the second embodiment of the present disclosure is described with reference to a flowchart of FIG. 14. In FIG. 14, the heat irradiator 421 is referred to as the "IR heater", and the ultraviolet irradiator 431 is referred to as the "UV-LED heater" as in the first embodiment of the present disclosure.

When the printer 1 starts printing (S20), the heat controller 801 takes in the detected thickness t1 of the sheet P detected by the thickness detector 831 (S21). Then, the heat controller 801 determines whether the detected thickness t1 of the sheet P is less than a predetermined thickness A (t1<A) (S22). The predetermined thickness A is also referred to as a "first thickness."

Here, when the detected thickness t of the sheet P is less than the predetermined thickness A (S22, YES), the heat controller 801 sets the output of the heat irradiator 421 from 0% to 50% and sets the output of the ultraviolet irradiator 431 to 100% (S23).

Conversely, when the detected thickness t1 of the sheet P is not less than the predetermined thickness A, that is, when the detected thickness t1 of the sheet material P is equal to or larger than the predetermined thickness A (t1≥A), that is NO in S22 in FIG. 14, the heat controller 801 determines whether the detected thickness t1 of the sheet P is less than a predetermined thickness B (B>A) (S24).

The predetermined thickness B is also referred to as a "second thickness." The second thickness (predetermined thickness B) is larger than the first thickness (predetermined thickness A).

When the detected thickness t of the sheet P is equal to or larger than the predetermined thickness A (S22, NO) and not less than the predetermined thickness B (S24, NO), that is when the detected thickness t1 of the sheet P is equal to or larger than the predetermined thickness B (S24, NO), the heat controller 801 sets the output of the heat irradiator 421 to 100% and sets the output of the ultraviolet irradiator 431 to 100% (S28).

Conversely, when the thickness of the sheet P is equal to or larger than the predetermined thickness A and less than the predetermined thickness B (A≤t1<B), the heat controller 801 determines whether the conveyance mode is the low-speed mode (first speed) or the high-speed mode (second speed) (S25).

In the hating device 400 according to the second embodiment, the user sets the conveyance mode as described above.

When the conveyance mode is set to the low-speed mode (S25, set low-speed mode), the heat controller 801 sets the output of the heat irradiator 421 from 0% to 100% and sets the output of the ultraviolet irradiator 431 from 70% to 100% (S26).

The heat controller 801 preferably sets the output of the heat irradiator 421 and the ultraviolet irradiator 431 so that a combination of the outputs satisfies a relation of (output of heat irradiator 421)/(output of ultraviolet irradiator 431) ≤0.60.

When the conveyance mode is set to the high-speed mode (S25, set high-speed mode), the heat controller 801 sets the output of the heat irradiator 421 to 100% and sets the output of the ultraviolet irradiator 431 to 100% (S27).

In the heat control of the heat irradiator 421 and the ultraviolet irradiator 431 in each of the step S23, S27, and S28, the heat controller 801 may apply the heat control as described in FIGS. 9 and 10 in the first embodiment.

Next, an operational effect of the hating device 400 according to the second embodiment is described below with reference to FIGS. 15A and 15B. FIGS. 15A and 15B are tables to illustrate the operational effect of the hating device 400 according to the second embodiment.

FIG. 15A is a table illustrating a result of a verification of a drying property and ripples on a surface of the sheet P by an inkjet printer. Here, the sheet P was conveyed at a speed of 1270 mm/s in the high-speed mode, and the sheet P was conveyed at a speed of 889 mm/s in the low-speed mode. Then, an image in which photographs and characters were mixed like a magazine was printed on four sides and printed on both sides, and the dryness of the image and the ripples on the blank part were evaluated.

In the high-speed mode, the heat controller 801 sets the output of the heat irradiator 421 to 100% and sets the output of the ultraviolet irradiator 431 to 100% although the ripples may occur on a surface of the sheet P whereas the drying property was achieved in the high-speed mode.

Hereinafter, the output of the heat irradiator 421 is also referred to as "IR output", and the output of the ultraviolet irradiator 431 is also referred to as "UV output". Result in FIG. 15A illustrates various combinations of the IR output of the heat irradiator 421 and the UV output of the ultraviolet irradiator 431 in the low-speed mode in comparison to the outputs in the high-speed mode as a reference. The IR output and the UV output in Low-speed mode is lowered from the IR output and the UV output in the high-speed mode.

The part marked with "x" in FIG. 15A indicates that the drying property was not achieved in the low-speed mode, that is, the sheet P could not be dried to a predetermined drying state.

From the result of FIG. 15A, it can be seen that if the total drying energy of the IR output of the heat irradiator 421 and the UV output of the ultraviolet irradiator 431 is insufficient, the drying property is not achieved.

Further, in FIG. 15A, "R1 to R5" are ranks of ripples on a surface of the sheet P. The ripples in the high-speed mode is used as a reference and is ranked as "R3". The ranks "R1" and "R2" indicate that a number of ripples increases (worsen), and the ranks "R4" and "R5" indicate that a number of ripples decreases (improved).

It can be seen from the result of FIG. 15A, it is preferable to reduce the UV output of the ultraviolet irradiator 431 to a small amount or none and significantly reduce the IR output of the heat irradiator 421 so that a ratio of an ultraviolet (UV) drying in the drying process is increased to improve the ripples (reduce a number of the ripples) on a surface of the sheet P.

Further, it can be seen from FIG. 15A that it is preferable to select one of the drying conditions in regions of ranks R4 and R5 surrounded by a thick frame in FIG. 15A to achieve both of drying property and improving the ripples (reduce ripples) on a surface of the sheet P in the low-speed mode.

FIG. 15B is a table illustrating a list of ratios of the IR output of heat irradiator 421 and the UV output of ultraviolet irradiator 431 (IR output/UV output) under the drying conditions of the low-speed mode.

In an example illustrated in FIG. 15B, a drying condition in the low-speed mode can significantly reduce the ripples on a surface of the sheet P as compared with the high-speed mode when the drying condition sets a ratio of the IR output of the heat irradiator 421 to the UV output of the ultraviolet irradiator 431 (IR output/UV output) to be equal to or less than 0.60.

Thus, when the thickness t of the sheet P is a predetermined thickness (A≤t<B), the heat controller 801 controls (switches) at least the output of the heat irradiator 421 based on the conveyance speed of the sheet P. At this time, the heat controller 801 decreases the output of the heat irradiator 421 when the conveyance speed of the sheet P is at the first speed to be smaller (lower) than the output of the heat irradiator 421 when the conveyance speed of the sheet P is at the second speed faster than the first speed.

Thus, the hating device 400 can reduce the ripples on the sheet P by using the heat irradiator 421 when the printer 1 prints the image pattern that easily generates the ripples on the sheet P having a predetermined thickness, for example, a thickness of about 128 gsm, even if the productivity is slightly reduced.

On the other hand, the hating device 400 can increase the productivity of drying operation in an image pattern that unlikely generates the ripples on a surface of the sheet P.

Figure 16:
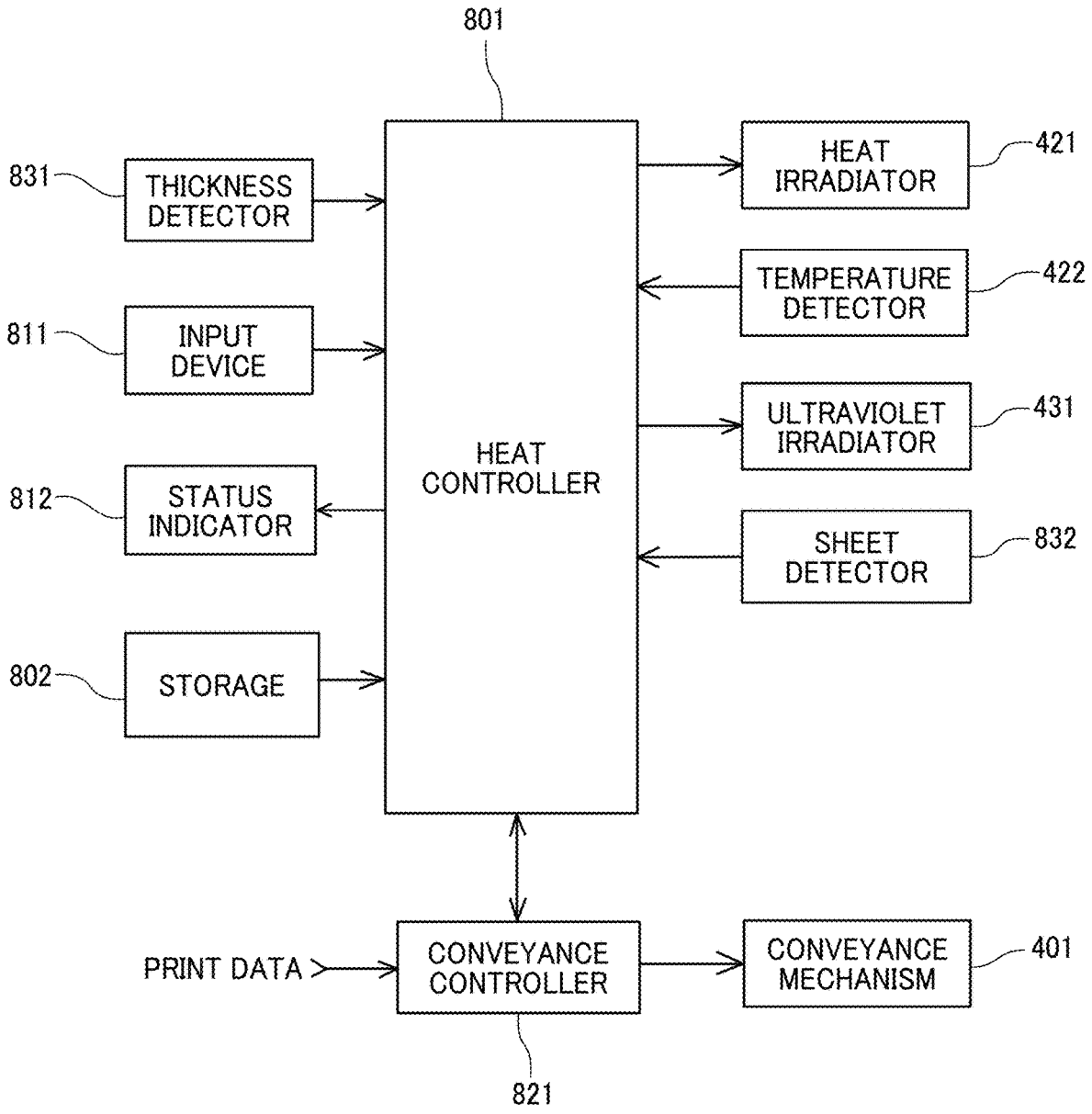
FIG. 16 is a block diagram of a portion related to a heat control according to the third embodiment of the present disclosure.

Next, the hating device 400 according to a third embodiment of the present disclosure is described with reference to FIG. 16. FIG. 16 is a block diagram of a portion related to a heat control according to the third embodiment of the present disclosure.

When the thickness t of the sheet P is a predetermined thickness, the conveyance controller 821 changes a conveyance speed of the sheet P by the conveyance belt 411 of the conveyance mechanism 401 via the conveyance controller 821 based on the liquid application amount (liquid adhesion amount) of the sheet P.

The conveyance controller 821 takes in the print data and determines whether a fluctuation amount of the liquid application amount on each predetermined area of the print pattern with respect to the sheet P exceeds the threshold value. Thus, the conveyance controller 821 determines whether the image pattern to be printed is a pattern that easily generates the ripples on a surface of the sheet P.

When the fluctuation amount does not exceed the threshold value and the image pattern does not easily generate ripples on the sheet P, the conveyance controller 821 sets the conveyance mode to the high-speed mode and sets the conveyance speed of the sheet P to a high speed. Conversely, when the fluctuation amount exceeds the threshold value and the image pattern easily generates ripples on the sheet P, the conveyance controller 821 sets the conveyance mode to the low-speed mode and sets the conveyance speed of the sheet P to a low speed.

Figure 17:
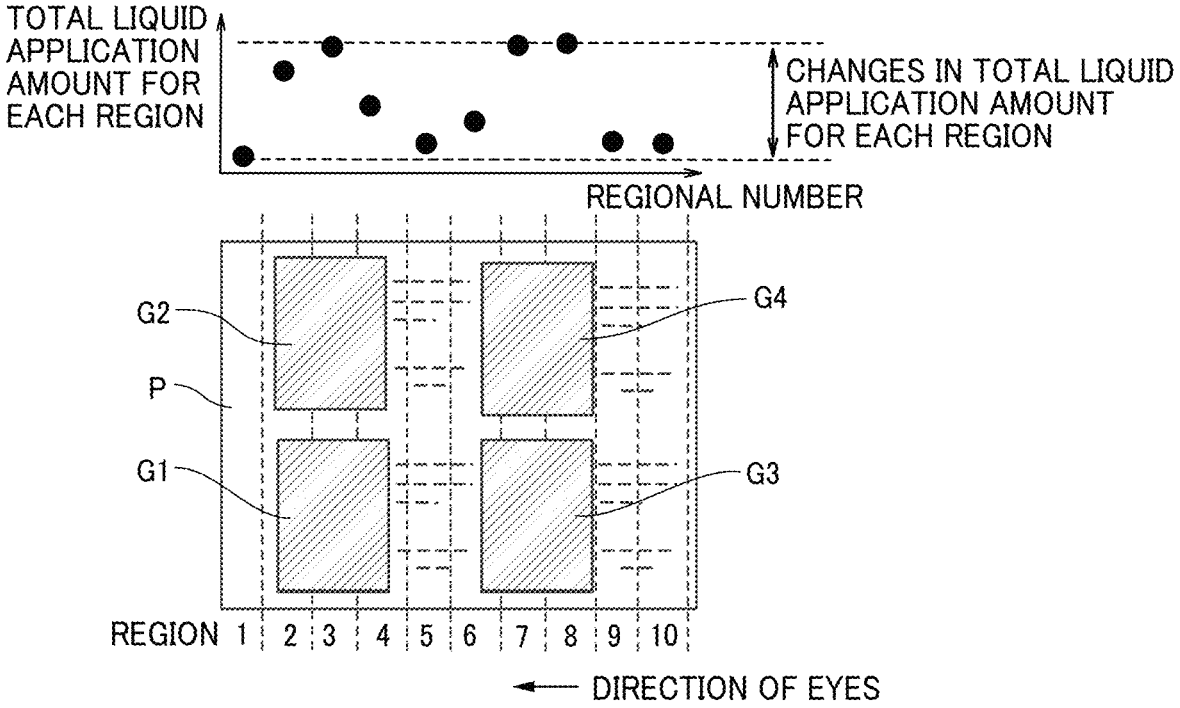
FIG. 17 is a set of graph and a plan view of the sheet illustrating a determination operation of an image pattern according to the third embodiment.

Next, an example of determining whether the image pattern is a pattern that easily generates ripples on the sheet P is described with reference to FIG. 17. FIG. 17 is a set of graph and a plan view of the sheet P illustrating a determination operation of the image pattern according to the third embodiment.

In an example as illustrated in a lower part of FIG. 17, photographs G1 to G4 are arranged on a sheet P of a grain long (GL) paper of 585 mm×750 mm. The sheet P was divided into ten regions from 1 to 10 at a pitch of 75 mm in a direction of the eyes, and a total liquid application amount for each area was calculated.

As illustrated in an upper part of FIG. 17, the regions 2, 3, 7, and 8 in which the photographs G1 to G4 are arranged are regions in which a total liquid application amount is large. The total liquid application amount is a total amount of liquid applied to each of the region. The regions 1, 5, 9, and 10 in which only margins and characters are arranged are regions in which the total liquid application amount is small.

Although the liquid application amount is calculated from the print data (image data) in the third embodiment, the liquid application amount may be obtained by detecting or counting liquid droplets discharged from each head, or by reading the image on the sheet P to calculate the liquid application amount.

Therefore, the conveyance controller 821 sets a (maximum value−minimum value) of the total liquid application amount for each of the regions 1 to 10 as the fluctuation amount. When the fluctuation amount exceeds the threshold value S, the conveyance controller 821 determines that the image pattern is likely to generate the ripples.

Specifically, the conveyance controller 821 standardizes the total liquid application amount for each regions 1 to 10 by a sheet area of each regions 1 to 10 and calculates the liquid application amount in a unit of "μl/cm2."

When the fluctuation amount=(maximum value−minimum value) of the total liquid application amount exceeds the threshold value S of 0.30 (μl/cm2), the conveyance controller 821 determines that the image pattern easily generates the ripples.

In a determination of the image pattern, the conveyance controller 821 conveys the sheet P at a low speed and dries the sheet P by increasing the ratio of the output of the ultraviolet irradiator 431 (UV drying) when the image pattern is a pattern that easily generates the ripples on a surface of the sheet P.

On the other hand, the conveyance controller 821 conveys the sheet P at a high speed to increase a pint productivity when the print pattern (image pattern) does not correspond to a pattern that easily generates the ripples on a surface of the sheet P.

Thus, conveyance controller 821 (circuitry) is configured to dividing the sheet into a plurality of regions 1 to 10), calculate a total amount of the liquid applied in each of the plurality of regions 1 to 10, calculate a maximum value of the total amount of the liquid in the plurality of regions 1 to 10, calculate a minimum value of the total amount of the liquid in the plurality of regions 1 to 10, calculate a difference between the maximum value and the minimum value, determine whether the difference exceeds a threshold value S. and controls the conveyance mechanism 401 (conveyor) to decrease the conveyance speed when the difference exceeds the threshold value S.

Next, an example of heat control according to the third embodiment of the present disclosure is described with reference to a flowchart of FIG. 18.

When the printer 1 starts printing (S30), the heat controller 801 takes in the detected thickness t1 of the sheet P detected by the thickness detector 831 (S31). Then, the heat controller 801 determines whether the detected thickness t1 of the sheet P is less than the predetermined thickness A (t1<A) (S32).

Here, when the detected thickness t1 of the sheet P is less than the predetermined thickness A (S32, YES), the heat controller 801 sets the output of the heat irradiator 421 from 0% to 50% and sets the output of the ultraviolet irradiator 431 to 100% (S33).

Figure 18:
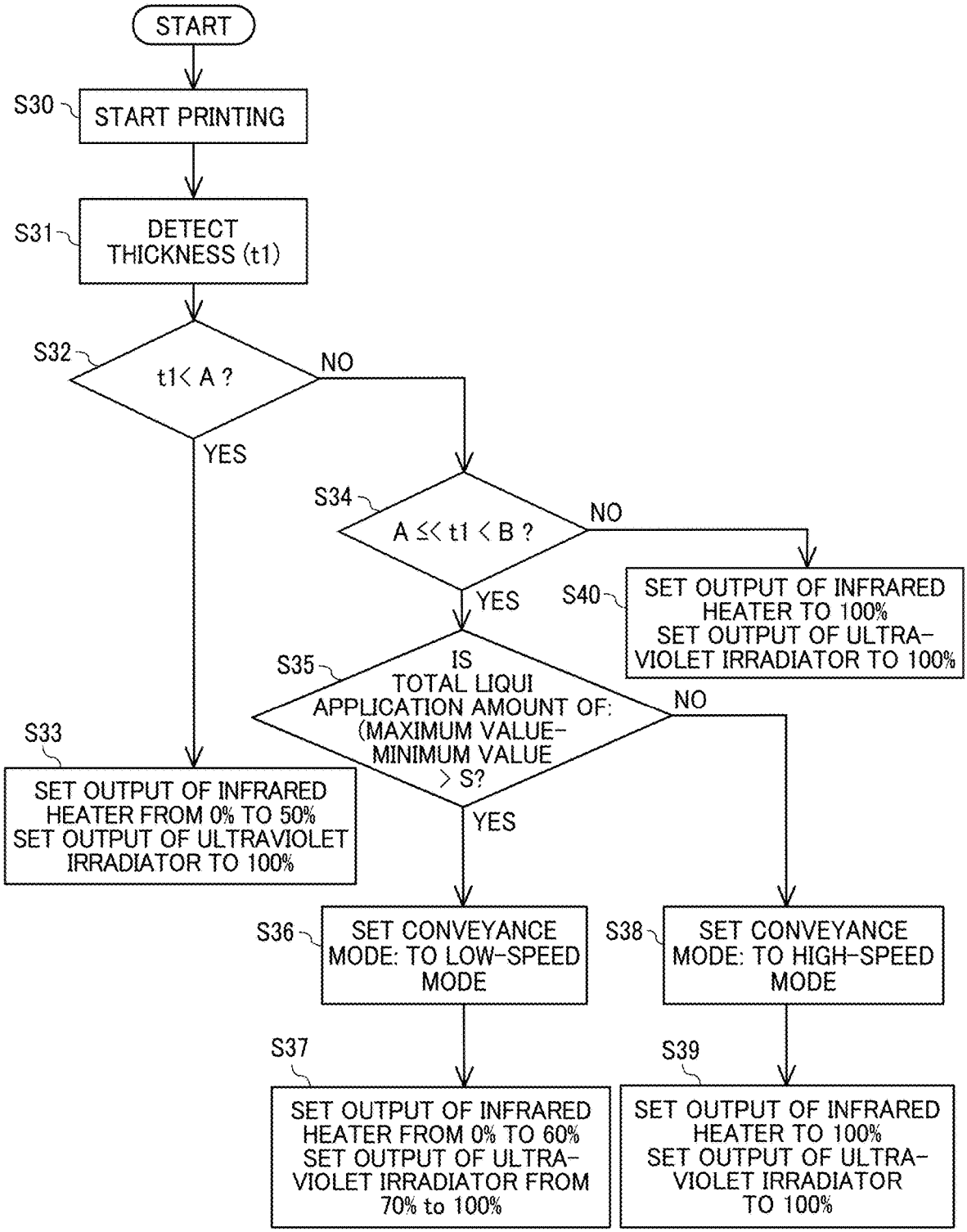
FIG. 18 is a flowchart illustrating an example of a heat control according to the third embodiment of the present disclosure.

Conversely, when the detected thickness t1 of the sheet P is not less than the predetermined thickness A, that is, when the detected thickness t1 of the sheet material P is equal to or larger than the predetermined thickness A (t1≥A), that is NO in S32 in FIG. 18, the heat controller 801 determines whether the detected thickness t1 of the sheet P is less than the predetermined thickness B (B>A) (S34).

When the detected thickness t1 of the sheet P is equal to or larger than the predetermined thickness A (S32, NO) and not less than the predetermined thickness B (S34, NO), that is when the detected thickness t1 of the sheet P is equal to or larger than the predetermined thickness B (S34, NO), the heat controller 801 sets the output of the heat irradiator 421 to 100% and sets the output of the ultraviolet irradiator 431 to 100% (S40).

Conversely, when the thickness of the sheet P is equal to or larger than the predetermined thickness A and less than the predetermined thickness B (A≤t1<B), the conveyance controller 821 determines whether the (maximum value−minimum value) of the total liquid application amount exceeds the threshold value S1, that is, the total liquid application amount satisfies the relation of ((maximum value−minimum value) of the total liquid application amount)>threshold value S1 (S35).

If the total liquid application amount satisfies the relation of ((maximum value−minimum value) of the total liquid application amount)>threshold value S1, the conveyance controller 821 sets the conveyance mode of the conveyance mechanism 401 to the low-speed mode and conveys the sheet P at the first speed (S36).

Then, the heat controller 801 sets the output of the heat irradiator 421 from 0% to 60% and sets the output of the ultraviolet irradiator 431 from 70% to 100% (S37). As described above, it is preferable to set the outputs of the heat irradiator 421 and the ultraviolet irradiator 431 such that the combination of the outputs satisfies the relation of (output of heat irradiator 421)/(output of ultraviolet irradiator 431) ≤0.60.

On the other hand, if the total liquid application amount does not satisfy the relation of ((maximum value−minimum value) of the total liquid application amount)>threshold value S1, the conveyance controller 821 sets the conveyance mode of the conveyance mechanism 401 to the high-speed mode and conveys the sheet P at the second speed (S38). Then, the heat controller 801 sets the output of the heat irradiator 421 to 100% and sets the output of the ultraviolet irradiator 431 to 100% (S39).

Thus, the heat controller 801 controls the conveyance mechanism 401 (conveyor) to decrease the conveyance speed to the first speed (low-speed mode) when the difference between the maximum value and the minimum value of the total liquid application amount exceeds the threshold value S.

In the heat control of the heat irradiator 421 and the ultraviolet irradiator 431 in each of the step S23, S39, and S40, the heat controller 801 may apply the heat control as described in FIGS. 9 and 10 in the first embodiment.

As described above, the hating device 400 according to the third embodiment can automatically sets the conveyance speed so that the user does not have to set the conveyance mode as compared with the hating device 400 according to the second embodiment.

Figure 19:
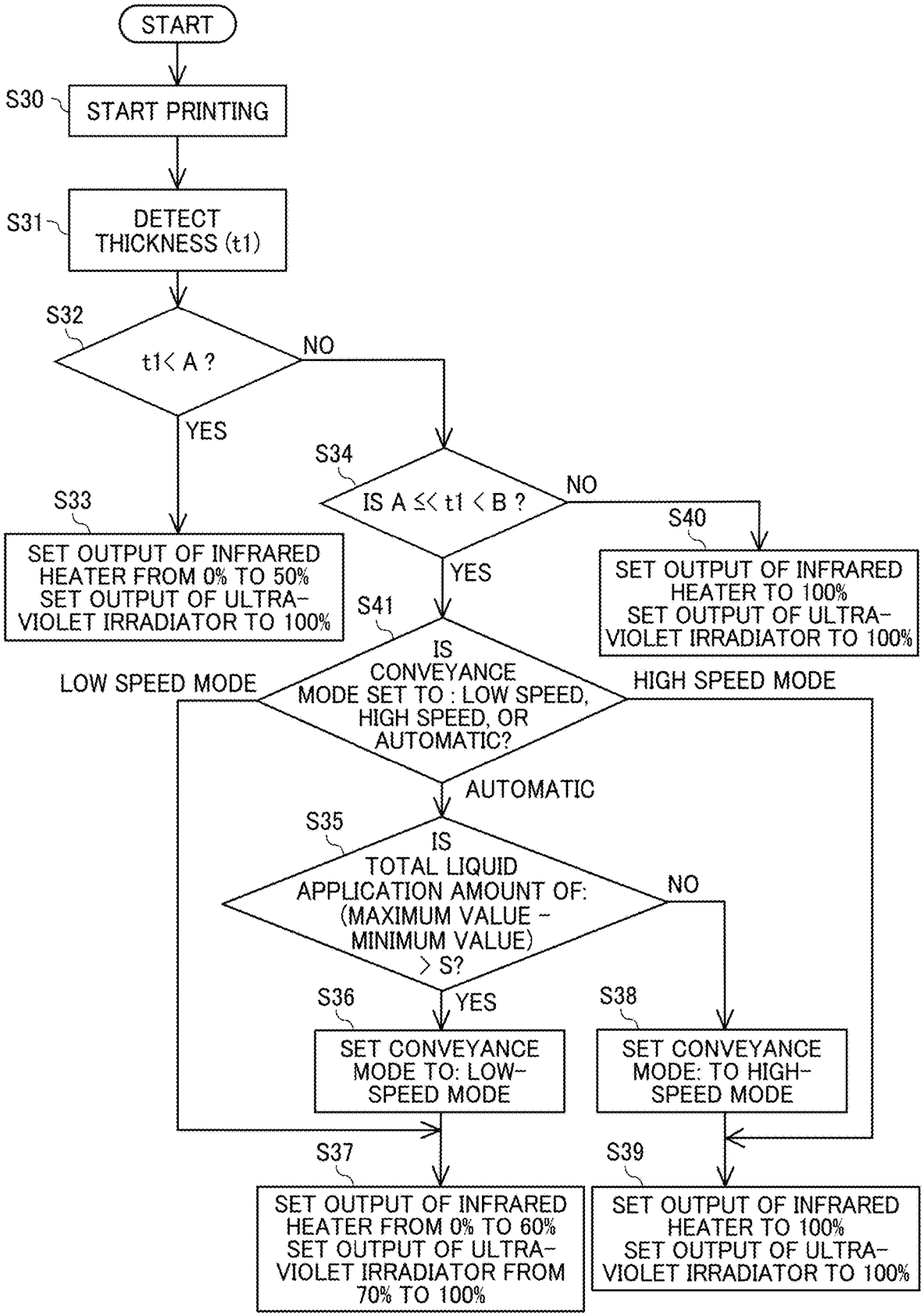
FIG. 19 is a flowchart illustrating an example of a heat control according to a fourth embodiment of the present disclosure.

Next, an example of heat control according to a fourth embodiment of the present disclosure is described with reference to a flowchart of FIG. 19.

The hating device 400 according to the fourth embodiment is a combination of the second embodiment and the third embodiment. As for the step numbers in FIG. 19, the same numbers are assigned to the same steps as the steps in the third embodiment illustrated in FIG. 18.

That is, in the step S34, when the thickness of the sheet P is equal to or larger than the predetermined thickness A and less than the predetermined thickness B (A≤t1<B), (S34, YES), the heat controller 801 executes step S41. In step 41, the heat controller 801 determines which conveyance mode of the low-speed mode, the high-speed mode, and automatic setting is set by the user.

The heat controller 801 proceeds the step from the step S41 to the step S37 if the user sets the conveyance mode to the low-speed mode. The heat controller 801 proceeds the step from the step S41 to the step S39 if the user sets the conveyance mode to the high-speed mode. The heat controller 801 proceeds the step from the step S41 to the step S35 if the user sets the conveyance mode to the automatic setting. The, the heat controller 801 sets the conveyance mode to one of the low-speed mode (S36) and the high-speed mode (S38) and then proceeds the process to the step S37 or the step S39.

Thus, the heating device 400 can increase the productivity of drying operation in an image pattern while reducing a generation of the ripples on the surface of the sheet P.

In the present embodiments, a "liquid" discharged from the head is not particularly limited as long as the liquid has a viscosity and surface tension of degrees dischargeable from the head.

However, preferably, the viscosity of the liquid is not larger than 30 mPa-s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media such as a paper sheet, recording paper, a recording sheet of paper, film, and cloth, electronic components such as an electronic substrate and a piezoelectric element, and media such as a powder layer, an organ model, and a testing cell.

The "material onto which liquid can adhere" includes any material on which liquid adheres unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the "liquid discharge apparatus" may be a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Each of the functions of the described embodiments such as the heat controller 801 and the conveyance controller 821 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A heating device comprising:

a heat irradiator configured to heat a sheet on which a liquid is applied and is conveyed in a conveyance direction;

an ultraviolet irradiator on a downstream of the heat irradiator in the conveyance direction, the ultraviolet irradiator configured to heat a portion of the sheet;

a conveyance belt for bearing and conveying the sheet within and out of the heating device;

and a circuitry configured to control an output of the heat irradiator and an output of the ultraviolet irradiator based on a thickness of the sheet, wherein the conveyance belt travels linearly across the heat irradiator and the ultraviolet irradiator arranged next to each other.

2. The heating device according to claim 1, further comprising:

a sheet detector configured to detect the sheet on the heat irradiator, wherein the circuitry is configured to:

control the heat irradiator not to irradiate the sheet with heat when a thickness of the sheet is less than a predetermined thickness and when the sheet detector detects the sheet; and control the heat irradiator to irradiate the sheet with heat when the thickness of the sheet is less than the predetermined thickness and when the sheet detector does not detect the sheet.

3. The heating device according to claim 1, further comprising a thickness detector configured to detect a detected thickness of the sheet.

4. The heating device according to claim 1, further comprising an input device configured to input an input thickness of the sheet to the heating device.

5. The heating device according to claim 1, further comprising:

a thickness detector configured to detect a detected thickness of the sheet; and an input device configured to input an input thickness of the sheet to the heating device.

6. The heating device according to claim 5, wherein the circuitry is configured to:

calculate a difference between the input thickness of the sheet input by the input device and the detected thickness of the sheet detected by the thickness detector;

determine whether the difference is less than a predetermined value; and control the output of the heat irradiator and the output of the ultraviolet irradiator based on the detected thickness of the sheet detected by the thickness detector when the difference is less than the predetermined value.

7. The heating device according to claim 5, wherein the circuitry is configured to:

determine whether the detected thickness of the sheet detected by the thickness detector is equal to or larger than a first thickness and less than a second thickness, the second thickness larger than the first thickness; and control the output of the heat irradiator based on a conveyance speed of the sheet conveyed in the conveyance direction when the thickness of the sheet is equal to or larger than the first thickness and less than the second thickness.

8. The heating device according to claim 7, wherein the circuitry is configured to:

control the output of the heat irradiator to be a first output when the conveyance speed of the sheet is at a first speed; and control the output of the heat irradiator to be a second output when the conveyance speed of the sheet is at a second speed, the second speed larger than the first speed, wherein the first output is smaller than the second output.

9. The heating device according to claim 8, wherein the circuitry is configured to:

control a ratio of the output of the heat irradiator to the output of the ultraviolet irradiator to be equal to or less than 0.60 when the conveyance speed of the sheet is at a first speed.

10. A liquid discharge apparatus comprising:

a liquid application unit configured to apply a liquid onto a sheet;

a conveyor configured to convey the sheet to the liquid application unit; and the heating device according to claim 1, the heating device configured to heat the sheet onto which the liquid is applied by the liquid application unit.

11. The liquid discharge apparatus according to claim 10, further comprising:

a thickness detector configured to detect a detected thickness of the sheet; and an input device configured to input an input thickness of the sheet to the heating device, wherein the circuitry is configured to:

calculate a difference between the input thickness of the sheet input by the input device and the detected thickness of the sheet detected by the thickness detector;

determine whether the difference is less than a predetermined value; and control at least one of the liquid application unit and the conveyor to stop a liquid application operation and a conveyance operation, respectively, when the difference is equal to or larger than the predetermined value.

12. The liquid discharge apparatus according to claim 10, wherein the circuitry is configured to:

control the conveyor to change a conveyance speed of the conveyor based on an amount of the liquid applied onto the sheet by the liquid application unit.

13. The liquid discharge apparatus according to claim 12, wherein the circuitry is configured to:

divide the sheet into a plurality of regions;

calculate a total amount of the liquid applied in each of the plurality of regions;

calculate a maximum value of the total amount of the liquid in the plurality of regions;

calculate a minimum value of the total amount of the liquid in the plurality of regions;

calculate a difference between the maximum value and the minimum value;

determine whether the difference exceeds a threshold value; and controls the conveyor to decrease the conveyance speed when the difference exceeds the threshold value.

14. A printer comprising:

a liquid application unit configured to apply a liquid onto a sheet; and the heating device according to claim 1, the heating device configured to heat the sheet onto which the liquid is applied by the liquid application unit.

15. The heating device according to claim 1, wherein the heating device includes a first sheet detector disposed upstream of the heat irradiator, a second sheet detector disposed between the heat irradiator and the ultraviolet irradiator, and a third sheet detector disposed downstream of the ultraviolet irradiator.

16. The heating device according to claim 1, wherein the conveyance belt is an endless belt stretched between a drive roller and a driven roller.

* * * * *